United States Patent [19]

Benthin

[11] 4,050,677

[45] Sept. 27, 1977

[54] MIXING DEVICE

[75] Inventor: Finn Benthin, Holbaek, Denmark

[73] Assignee: A/S Hotaco, Holbaek, Denmark

[21] Appl. No.: 648,806

[22] Filed: Jan. 13, 1976

[30] Foreign Application Priority Data

Jan. 20, 1975 United Kingdom ..... 2289/75
May 2, 1975 United Kingdom ..... 18408/75

[51] Int. Cl.[2] ..... B01F 5/18; B28C 5/06

[52] U.S. Cl. ..... 366/11; 261/78 A; 366/101

[58] Field of Search ..... 259/4 R, 18, 147, 151; 239/406, 419, 424, 424.5, 432; 261/78 A, DIG. 26

[56] References Cited

U.S. PATENT DOCUMENTS

| | | | |
|---|---|---|---|
| 1,451,063 | 4/1923 | Anthony | 239/406 |
| 1,849,945 | 3/1932 | Mobley et al. | 259/4 R X |
| 2,186,214 | 1/1940 | Simon | 239/406 X |
| 3,298,669 | 1/1967 | Zingg | 259/4 R |
| 3,338,560 | 8/1967 | Katzer et al. | 259/4 R |
| 3,478,963 | 11/1969 | Winn | 259/4 R X |

*Primary Examiner*—Robert W. Jenkins
*Attorney, Agent, or Firm*—Wenderoth, Lind & Ponack

[57] ABSTRACT

A device for the in situ building up of fibre-reinforced mortars and plastics, said includes an inner tube serving to forward a stream of air-born fibres. Surrounding the inner tube is a jacket with means for supplying pressurized air thereto, and having at its front end an inward inclining slit or bores. Surrounding the jacket is an outer tube with means for supplying the product to be reinforced thereto, the outer tube having an outlet at its front end for passage of the mixture leaving the device.

6 Claims, 1 Drawing Figure

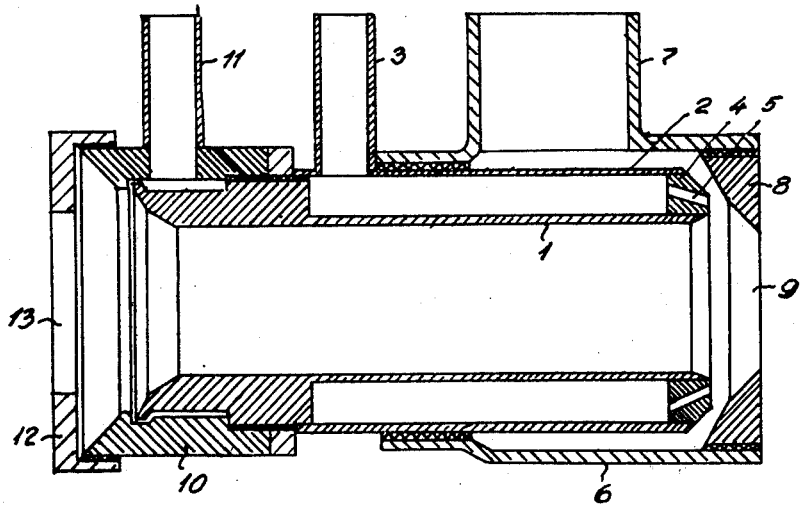
11
3
7
2
4
5
8
1
9
13
12
10
6

MIXING DEVICE

BACKGROUND OF THE INVENTION

This invention relates to a device for in situ producing and building up of a fibre-reinforced construction material, particularly a mortar or a plastic.

It is well known that by incorporating fibres into e.g. lime mortar and cement mortar, the strength of the mortar after setting is substantially increased. Any kind of fibres will have this effect, but inorganic fibres are preferred, such as asbestos fibres, mineral wool and glass wool, especially in the form of glass wool made from alkaliresistant glass.

The reinforced mortars have many uses, such as in the production of light partitions, and of kerbstones, or to make fire-inhibiting coatings on supporting structures, as well as in the production of substitute materials for wood in the building trade, especially for making window frames and door frames for use in the manufacture of prefabricated building units.

In order to reduce manufacturing costs, several attempts have been made to produce the fibre-reinforced mortar mixture in situ. In the most successful attempt of this kind, an air-born stream of glass fibres is produced by feeding glass wool in rowings to a cutter and blowing the cut fibres out through a tube by means of pressurized air. At the end of the tube two oppositely mounted, inclined nozzles are mounted to spray a low-viscous mortar into the air-born stream of glass fibres to produce a mixture of mortar and fibres immediately before depositing the mixture at the site of use.

By this method, however, it is difficult to avoid severe losses of both fibres and mortar, since the intermixing depends on the mortar splashes hitting and attaching themselves to the individual tufts of fibres produced by the cutter. Also, the fibres settle at random on the surface, to which the mixture is applied, with the result that extensive after-treatment is required to orient the fibres parallel to the surface and to remove possibly enclosed air bubbles.

Since this after-treatment has to be carried out manually by applying rollers to the surface of the coating, any improvement in respect of making the fibres in the mixture settle parallel to the surface of the coated object will mean a saving in costs.

Fibres are also used for reinforcing fillerized plastics of the kind being cured by addition of a hardening agent, e.g. plastics of the epoxy or polyester type.

Although such fibre-reinforced plastics are increasingly used in constructional work, ranging from boat hulls to bathing cabinets, apparently it has not hitherto been possible to provide a device by which a mixture of fibres and heavily fillerized plastics can be produced in situ.

SUMMARY OF THE INVENTION

The object of the present invention is thus to provide a device by means of which the losses in intermixing of fibres and construction materials, such as mortar or plastic, are substantially reduced as is also the necessary aftertreatment to submerge outsticking fibre tufts.

With this object in view, a device according to the invention comprises in combination an inner tube, serving to forward a stream of air-born fibres, a jacket provided with means for admitting pressurized air to the interior thereof surrounding the inner tube, the jacket having at its front end, in relation to the direction of the air-born stream of fibres, inward inclining bores or a conical, annular slit surrounding the inner tube, elongations of the generatrices of which will join at a point in front of the device, and an outer tube surrounding the jacket, to which tube mortar can be supplied, the tube being closed at the back end, and its front end having an opening in front of the inner tube for passage of the mixture which is formed in the device.

The basic idea in the design of the present mixing device is thus to forward the components to be mixed separately to a position adjacent the front end of the device, where the material to be reinforced is split up in particles or drops by the pressurized air and mixed with the air-born fibres just before leaving the device, the mixture being concentrated in front of the device by the inward inclining air jets.

In a device as thus specified, the air-born stream of fibres is confined and accellerated by the pressurized air supplied to the surrounding jacket. The mortar or plastic supplied to the outer tube is forced into the accellerated stream of air-born fibres from around its whole circumference thus ensuring a good mixture thereof with the fibres and substantially preventing any loss of fibres. The pressurized air supplied through the inclined opening or openings in the jacket will tend to concentrate the mixture in a small area in front of the device, and the increased velocity of the mixture will tend to flatten the fibre tufts against the surface to be coated, thus reducing the necessity of after-treatment.

The device is further advantageous in being designed so as to avoid compressing mortar to make it pass through a nozzle or a narrow slit. This is extremely important, since any compression of the mortar tends to destroy its homogenity by impeding the passage of the larger particles more than that of the liquid and finer particles with the result of a building up of the larger particles to block the passage.

In one embodiment of the present device, the outer tube is in the shape of a diminishing socket, having a connection for admitting the mortar or plastic, the socket being screwed onto the jacket, and having at its front end an inner threading into which is screwed a closure having a central opening for the passage of the mixture produced in the device. This makes it possible to adjust the space between the front end of the inner tube and the closure of the outer tube so as to adjust the amount of mortar or plastic sprayed onto the fibres.

In a further embodiment of the device, the jacket enclosing the inner tube is closed at the front end by means of an exchangeable ring filling out the space between the jacket and the inner tube, the ring being provided with the conically inclined bores or the conical slit. This provides means for adjusting the pressurized air supply by exchanging the ring with another one having greater or smaller bores or a slit of greater or smaller width.

In a further embodiment, the ring may be in two parts, one part with a conical outer surface being fitted upon the inner tube, the other with a corresponding conical surface being fitted into the jacket. By mounting one of the two parts longitudinally movable the intervening slit can thus be made wider or narrower.

BRIEF DESCRIPTION OF THE DRAWING

An embodiment of the present device will be described in more detail below with reference to the accompanying drawing which is a section through the device, the description being in connection with its use for mixing fibres and plastics.

DETAILED DESCRIPTION OF THE INVENTION

The device shown in longitudinal section in the drawing has an inner steel tube 1 surrounded by a steel jacket 2 with a connector 3 for pressurized air. A steel closure 4 closes the gap between tube 1 and jacket 2 at the front end and has at least one air passage 5 suitably extending around the tube 1 and inclining towards the axis of the device.

Closure 4 may be in the form of a ring, and the passage 5 may be in the form of a plurality of bores spaced around the ring or an annular, conical slit in the ring. Alternatively, closure 4 may be in two parts, i.e. an inner part attached to the inner tube and having a conical outer surface, and an outer part attached to the jacket and having a conical inner surface. The passage 5 is annular and is defined between the inner surface of the outer part and the outer surface of the inner part.

An outer tube 6 of larger diameter than the jacket 2 surrounds jacket 2, its back end being of reduced diameter with an inner threading for engaging an outer threading on the jacket 2.

The outer tube 6, having a connector 7, extends in front of the jacket 2 and the inner tube 1 and has in its front end a plug 8 with a central opening 9 of conical shape. The smallest diameter of opening 9 is substantially equal to the diameter of the inner tube 1.

On the back end of the inner tube 1 is screwed a socket 10 with a connector 11 and closed by a cap 12 with a central opening 13 into which a cutter (not shown) for supplying fibres to the inner tube may be fitted. The cutter is of a known type which is driven by pressurized air, and the fibres or fibre tufts produced by the cutter are blown forward through the inner tube by means of air supplied through the connector 11.

Unhardened plastic is supplied through the connector 7, and pressurized air is supplied to the jacket 2 through the connector 3, preferably together with a hardening agent, which is atomized into the pressurized air.

The plastic passes through the interspace between jacket 2 and outer tube 6 towards the opening 9, thus passing the passage 5. The jets or jet of air from passage 5 disrupt the stream of unhardened plastic to drops and supply the hardening agent, just where the stream of air-borne fibres leaves the inner tube 1, and the whole is mixed just before the opening 9, where the mixture leaves the device.

What is claimed is:

1. In a device for the in situ formation of fibre-reinforced construction materials, such as mortars and plastics, such device being of the type including an elongate member, means to introduce fibres into a first end of said elongate member, and means for mixing construction material to be reinforced with said fibres at a second end of said elongate member, the improvement comprising:

said elongate member comprises a cylindrical inner tube having first and second ends, said fibres being introduced into said first end of said inner tube;

first gas connection means adjacent said first end of said inner tube for supplying gas into said inner tube to convey said fibres through said inner tube from said first end through said second end thereof;

a jacket surrounding said inner tube and having first and second ends, said first end of said jacket being connected to said inner tube, said second end of said jacket positioned adjacent but radially outwardly of said second end of said inner tube, said jacket and inner tube defining therebetween an annular first space;

an outer tube surrounding said jacket and having first and second ends, said first end of said outer tube being connected to said jacket, said second end of said outer tube extending axially beyond said second ends of said inner tube and said jacket, said outer tube and said jacket defining therebetween an annular second space;

connection means attached to said outer tube for introducing construction material to be reinforced into said second space and conveying said material through said second space in a direction toward said second end of said outer tube;

plug means positioned within said outer tube at said second end thereof for conveying said material from said second space toward said fibres passing through said second end of said inner tube, to thereby form a material-fibre mixture, said plug means having a central opening therethrough for passage of said mixture;

second gas connection means attached to said jacket for introducing gas into said first space and conveying said gas in a direction toward said second ends of said inner tube and said jacket; and closure means positioned adjacent said second ends of said inner tube and said jacket for closing said first space, said closure means having extending therethrough inclined passage means surrounding said inner tube and extending from said first space toward said plug means and radially inwardly, for forming at least one gas jet surrounding said inner tube, said passage means being dimensioned to direct said at least one gas jet against said material being conveyed toward said fibres to disrupt said material into drops before mixture thereof with said fibres.

2. The improvement claimed in claim 1, wherein said closure means comprises a ring removably positioned between said inner tube and said jacket.

3. The improvement claimed in claim 2, wherein said passage means comprises a plurality of bores circumferentially spaced about said ring.

4. The improvement claimed in claim 2, wherein said passage means comprises an annular conical slit extending circumferentially through said ring.

5. The improvement claimed in claim 1, wherein said closure means comprises a first inner ring part attached to said inner tube and having a conical outer surface, and a second outer ring part attached to said jacket and having a conical inner surface, and said passage means comprising an annular conical slit defined between said inner surface of said outer ring part and said outer surface of said inner ring part.

6. The improvement claimed in claim 1, wherein said plug means comprises a plug member threaded into said second end of said outer tube, whereby the spacing between said plug member and said closure means is adjustable.

* * * * *